US007973745B2

(12) United States Patent
Mizukoshi et al.

(10) Patent No.: US 7,973,745 B2
(45) Date of Patent: Jul. 5, 2011

(54) ORGANIC EL DISPLAY MODULE AND MANUFACTURING METHOD OF THE SAME

(75) Inventors: Seiichi Mizukoshi, Kanagawa (JP); Nobuyuki Mori, Saitama (JP); Makoto Kohno, Kanagawa (JP); Kouichi Onomura, Kanagawa (JP)

(73) Assignee: Global OLED Technology LLC, Wilmington, DE (US)

( * ) Notice: Subject to any disclaimer, the term of this patent is extended or adjusted under 35 U.S.C. 154(b) by 321 days.

(21) Appl. No.: 12/369,175

(22) Filed: Feb. 11, 2009

(65) Prior Publication Data

US 2009/0207106 A1 Aug. 20, 2009

(30) Foreign Application Priority Data

Feb. 20, 2008 (JP) ..... 2008-038857

(51) Int. Cl.
*G09G 3/30* (2006.01)

(52) U.S. Cl. ..... 345/76; 345/77; 345/95; 345/210

(58) Field of Classification Search ..... 345/76–83, 345/89–96, 204–215
See application file for complete search history.

(56) References Cited

U.S. PATENT DOCUMENTS

| | | | | |
|---|---|---|---|---|
| 6,518,962 | B2 | 2/2003 | Kimura et al. | |
| 6,633,135 | B2 | 10/2003 | Nara et al. | |
| 7,199,602 | B2 | 4/2007 | Nara et al. | |
| 7,345,660 | B2 | 3/2008 | Mizukoshi et al. | |
| 2007/0210996 | A1 | 9/2007 | Mizukoshi et al. | |
| 2010/0214273 | A1 * | 8/2010 | Shirouzu et al. | 345/205 |
| 2010/0245331 | A1 * | 9/2010 | Shirouzu et al. | 345/212 |
| 2010/0259527 | A1 * | 10/2010 | Odawara et al. | 345/211 |

* cited by examiner

*Primary Examiner* — Vijay Shankar
(74) *Attorney, Agent, or Firm* — McKenna Long & Aldridge LLP

(57) ABSTRACT

On a panel, a plurality of PVDD lines, each of which corresponds to a horizontal line of pixels and supplies power to the pixels of the horizontal line, are provided. A voltage drop correction unit that obtains a voltage drop before reaching the pixel, based on resistance in the plurality of power supply lines and currents flowing therein, and corrects display data so as to cancel the obtained voltage drop of the pixel. A display unevenness correction unit that corrects uneven brightness caused by a variation in a TFT characteristic of the pixel by performing a calculation using display data of the pixel and obtained correction data of the pixel.

3 Claims, 17 Drawing Sheets

PRIOR ART

PRIOR ART

PRIOR ART

PRIOR ART

ORGANIC EL DISPLAY MODULE AND MANUFACTURING METHOD OF THE SAME

CROSS-REFERENCE TO RELATED APPLICATION

This application claims priority of Japanese Patent Application No. 2008-038857 filed Feb. 20, 2008 which is incorporated herein by reference in its entirety.

FIELD OF THE INVENTION

The present invention relates to an active organic EL display module in which pixels are arranged in a matrix, each pixel having an organic EL element for display use and a TFT that controls current supply to the organic EL element.

BACKGROUND OF THE INVENTION

FIG. 1 shows a configuration of a circuit of a single pixel (pixel circuit) in a basic active organic EL display device. FIG. 2 shows one example of a configuration of a display module and an input signal.

As shown in FIG. 1, a pixel circuit is composed of a selection TFT 2 in which either a source or a drain is connected to a data line Data and a gate is connected to a gate line Gate, a drive TFT 1 having a gate connected to either the source or the drain of the selection TFT 2 and a source connected a power supply PVdd, a storage capacitor C connecting between the gate and the source of the drive TFT 1, and an organic EL element 3 having an anode connected to the drain of the drive TFT 1 and a cathode connected to a low voltage power supply CV.

Further, as shown in FIG. 2, pixels 14, each having the pixel circuit as shown in FIG. 1, are arranged in a matrix to form a display section. A source driver 10 and a gate driver 12 are provided to drive the pixels of the display section.

An image data signal, a horizontal synchronization signal, a pixel clock, and other drive signals are supplied to the source driver 10, and a horizontal synchronization signal, a vertical synchronization signal, and other drive signals are supplied to the gate driver 12. The data lines Data extend from the source driver 10 for the respective columns of the pixels 14 in the vertical direction, while the gate lines Gate extend from the gate driver 12 for the respective rows of the pixels 14 in the horizontal direction.

When the gate line (Gate) extending in the horizontal direction is set to a high level to turn on the selection TFT 2, and, while in this state, a data signal having a voltage based on the display brightness is fed to the data lines extending in the vertical direction, a data signal is stored in the storage capacitor C. Subsequently, the drive TFT 1 supplies a drive current based on the data signal stored in the storage capacitor C to the organic EL element 3, and the organic EL element emits light.

Here, the current and the amount of luminescence in the organic EL element 3 are substantially proportional to each other. Typically, a voltage (Vth) that causes a drain current to start to flow at a level near the black level of an image is applied across the gate and the PVdd (Vgs) of the drive TFT 1. Further, as an amplitude of the image signal, an amplitude by which a predetermined brightness is achieved at a level near the white level is applied.

FIG. 3 shows a relationship between an input signal voltage (voltage of the data line Data) of the drive TFT 1 and a CV current flowing in the organic EL element 3 (corresponding to brightness). By setting a data signal (data voltage) such that Vb is applied as a black level voltage and Vw is applied as a white level voltage, it is possible to control the amount of luminescence from black to white in the organic EL element 3 and appropriately perform gradation control. Here, as is apparent from FIG. 3, the voltage input to a pixel (data voltage) and the current are not completely proportional to each other. Accordingly, as shown in FIG. 4, image data and brightness are placed in a linear relationship through gamma correction circuits (γLUT) 16 (16*r*, 16*g*, and 16*b*). An image data signal is a signal indicating brightness for each pixel, and, because the image data signal is a color signal, it is composed of color-specific image data signals rn, gn, and bn. As such, the three gamma correction circuits 16*r*, 16*g*, and 16*b* corresponding to colors R, G, and B, respectively, are provided, and these gamma correction circuits output the gamma-corrected image data signals Rn, Gn, and Bn, respectively. As such, the image data signals Rn, Gn, and Bn are supplied to the source driver 10. These image data signals are then supplied to the data lines Data and further supplied to R display pixels 14, G display pixels 14, and B display pixels 14, respectively. As shown in the figure, the source driver 10 includes a shift register 10*a* that temporarily stores the image data signal for each pixel, and a data latch and D/A 10*b* that latches image data signals for one horizontal line stored in the shift register 10*a*, simultaneously performs D/A conversion on the data for one horizontal line, and outputs the results. Further, a region in which a plurality of pixels 14 are arranged in a matrix is illustrated as an effective pixel region 18 of a display panel. Displaying is performed in this region based on the image data signals.

Here, when a single pixel is driven at a certain input voltage, its brightness varies with Vth of the drive TFT 1. An input voltage near PVdd-Vth is equivalent to a signal voltage for displaying black color. Likewise, a slope (μ) of a V-I curve of the TFT also often varies. In such a case, an input amplitude (Vp-p) to achieve a given brightness varies, and an amplitude from a voltage for displaying the black level to a voltage for displaying the white level also varies.

Variance in the Vth or the μ of the drive TFT 1 of the pixels 14 in the display panel (pixel matrix: effective pixel region) usually results in uneven brightness of the display panel. In order to correct such uneven brightness, the pixels are illuminated at several different signal levels, and panel currents flowing therein are measured to thereby obtain V-I curves of the drive TFTs 1 of the individual pixels. Then, unevenness in brightness can be reduced by calculating correction data for each pixel based on the measured V-I curve for each of the pixels, performing calculation using the calculated correction data and the original image data signal, and supplying the result to the panel (see U.S. Pat. Nos. 7,345,660; 6,633,135; 7,199,602, 6,518,962 and U.S. Patent Application Publication No. 2007/0210996).

Further, although stray capacitance and resistance components caused by wiring are not illustrated in the pixel circuit shown in FIG. 1, in reality, in consideration of wiring resistance, stray capacitance, and other factors, the respective types of wiring lines include distributed constant circuits (RC distributed constant circuits) 20 as shown in FIG. 5. That is, there are provided a distributed constant circuit 20-1 on the gate line Gate, a distributed constant circuit 20-2 on the data line, a distributed constant circuit 20-3 on the power supply line, and a distributed constant circuit 20-4 between the organic EL element 3 and the power source CV. Because, as shown in FIG. 2, the PVDD line (power supply line) is connected to a plurality of pixels, under the presence of resistance components, the voltage at the source of the drive TFT 1 driving an organic EL element 3 changes depending on the size of currents of other pixels. In other words, with the plurality of pixels being connected to the same PVDD line, the voltage drops by a greater amount when the currents in the pixels are greater. When the selection TFT 2 is turned on and the data voltage is written in the storage capacitor C in a state where the source voltage of the drive TFT 1 is dropped, an absolute value of Vgs becomes smaller and a pixel current (CV current) flowing in the organic EL element 3 is reduced, resulting in lower brightness. FIG. 6 shows a phenomenon referred to as crosstalk caused by the above-described voltage drop in a panel in which power supply lines are provided in parallel to the horizontal lines of the pixels. When a white window is displayed on a gray background, the brightness in portions b and c is darker than in portions d and e. This phenomenon occurs because a current in a horizontal line containing white color is greater than a current in a horizontal line containing no white color, and the voltage drop becomes greater.

In order to address such a problem, U.S. Pat. No. 7,071,635 discloses predicting currents flowing in pixels of a horizontal line from data of all the pixels of the horizontal line, obtaining voltage drops in data voltages supplied to the pixels based on resistance in the power supply line and the predicted currents, and supplying image data signals corrected based on the obtained result. With such a configuration, it is possible to virtually cancel the voltage drop caused by the resistance components in the power supply line extending in the horizontal direction.

However, in this case, resistance in the vertical power supply line which connects between power supply lines of the horizontal lines and supplies power to these horizontal power supply lines must be negligible. If the vertical power supply line includes a resistance component, the brightness changes in the vertical direction due to a voltage drop caused by the resistance component.

As described above, a pixel current is measured by writing pixel data in the storage capacitor C and then monitoring the PVDD or the CV current. However, the current to be measured changes due to, for example, wiring resistance and stray capacitance, and gradually increases after the pixel data are written in the storage capacitor C. As such, the current must be measured after the current is sufficiently stabilized, and a considerable amount of time is required to measure pixel currents for all effective pixels after stabilization.

FIG. 7 shows an example of a relationship between the current Id flowing in the organic EL element 3 and the PVDD current (current Ipvdd flowing from the power supply PVDD). As shown in this figure, a considerable amount of time is required for stabilization of the current flowing in a PVdd in each of the pixels.

In addition, an unevenness correction value does not usually take into consideration a supply voltage drop at a pixel circuit. The accuracy of such correction therefore becomes worse as the voltage to be supplied to the pixel is reduced. It is thus understood that supply voltage drops are preferably corrected at the same time as unevenness in the pixels, as in U.S. Pat. No. 7,071,635 as described above. However, when a vertical PVDD line includes a resistance component, uneven distribution of supply voltages occurs in the vertical direction, and this causes display unevenness.

SUMMARY OF THE INVENTION

According to one aspect, the present invention is an active organic EL display module which has pixels arranged in a matrix, each of the pixels having an organic EL element for display use, and a TFT for controlling current supply to the organic EL element, the active organic EL display module further including: a plurality of power supply lines, each provided for one horizontal line of pixels and supplying power to pixels of the corresponding horizontal line; a voltage drop correction unit that obtains a voltage drop occurring before arrival at the pixel, based on resistance in the plurality of power supply lines and currents flowing therein, and that corrects display data so as to cancel the obtained voltage drop at the pixel; and a display unevenness correction unit that corrects uneven brightness caused by a variation in a TFT characteristic of the pixel by performing calculation using display data of the pixel and correction data of the pixel obtained in advance, and, in this module, a plurality of independent wiring terminals are provided on an end portion of a substrate on which the pixels are formed; and the plurality of power supply lines are separated into groups each having one or more power supply lines, and are connected to the independent wiring terminals on a per-group basis.

According to another aspect, the present invention is an active organic EL display module which has pixels arranged in a matrix, each of the pixels having an organic EL element for display use and a TFT for controlling current supply to the organic EL element, the active organic EL display module further including: a plurality of power supply lines, each provided for one horizontal line of pixels and supplying power to pixels of the corresponding horizontal line; a voltage drop correction unit that obtains a voltage drop occurring before arrival at the pixel based on resistance in the plurality of power supply lines and currents flowing therein, and that corrects display data so as to cancel the obtained voltage drop at the pixel; and a display unevenness correction unit that corrects uneven brightness caused by a variation in a TFT characteristic of the pixels by performing calculation using display data of the pixel and correction data of the pixels obtained in advance, and, in this module, a plurality of independent wiring terminals are provided on an end portion of a substrate on which the pixels are formed; the plurality of power supply lines are separated into groups each having one or more power supply lines, and are connected to the independent wiring terminals on a per-group basis; and connection terminals are connected by a conductor.

Further, each of the groups preferably includes a single power supply line, and the plurality of power supply lines are connected to the independent wiring terminals, respectively.

A method of manufacturing the active organic EL display module according to an aspect of the present invention includes collecting unevenness correction data by applying a voltage from outside to only the wiring terminal portion of a group including a power supply line of a horizontal line to which a measurement target pixel belongs and measuring currents flowing in a corresponding single or plurality of power supply lines; and assembling all the wiring terminals by coupling them by a conductor.

Further, it is preferable to apply a voltage from outside to the wiring terminal portion of a group including a plurality of power supply lines and measure currents flowing in the power supply lines of the group simultaneously, thereby collecting unevenness correction data for a plurality of pixels simultaneously.

According to the present invention, a measurement time of data used in correcting display unevenness can be reduced, and, further, influence of a resistance component in a power supply line extending in the vertical direction can be removed, to thereby prevent occurrence of display unevenness.

DETAILED DESCRIPTION OF THE INVENTION

An embodiment of the present invention will be described hereinafter by reference to the drawings.

Basic Configuration of the Embodiment

In the present embodiment, power supply lines for supplying power to pixels arranged in a matrix are provided for respective horizontal lines of pixels, and one end or both ends of these power supply lines extending in the horizontal direction are connected for each line or for each plurality of lines and are further connected to independent wiring terminals on an end portion of the substrate on which the pixels are formed.

When measuring a pixel current during the manufacturing process, a voltage is applied from outside only to a wiring terminal connected to a horizontal line to which a pixel to be measured belongs, and a current flowing in the power supply line is then measured. After measurement, all the wiring terminals are coupled by way of a wiring material, which has low resistance and is connected to the wiring terminals, and connected to a panel drive power supply.

Figure 1:
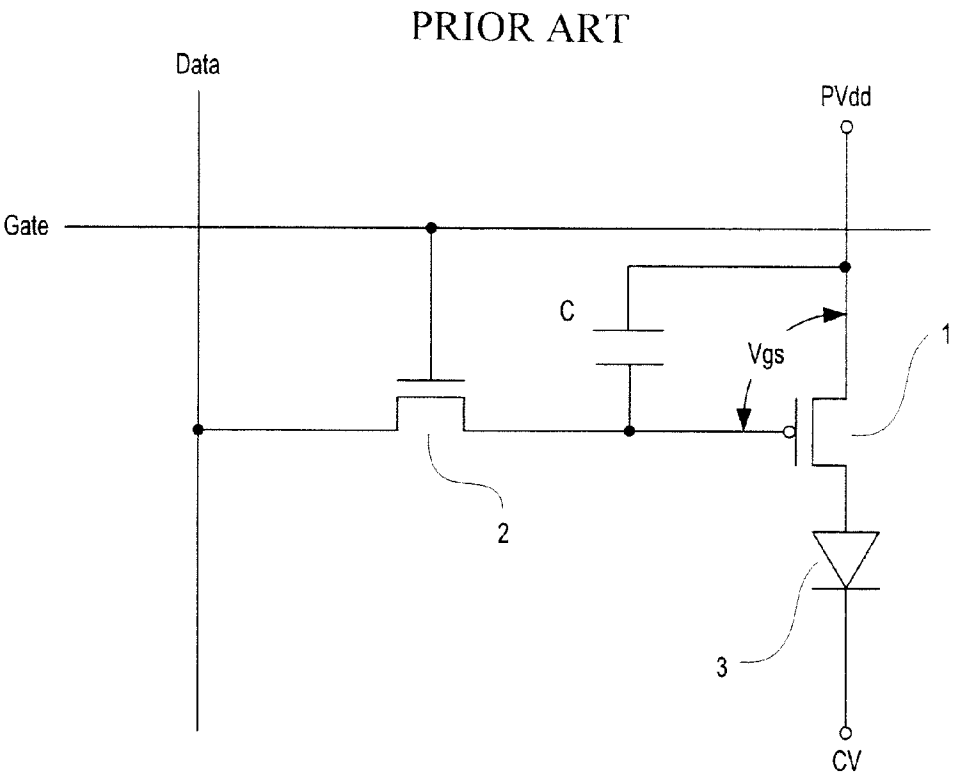
FIG. 1 shows an example configuration of a circuit for a single pixel (pixel circuit) in a basic active organic EL display device.
Figure 2:
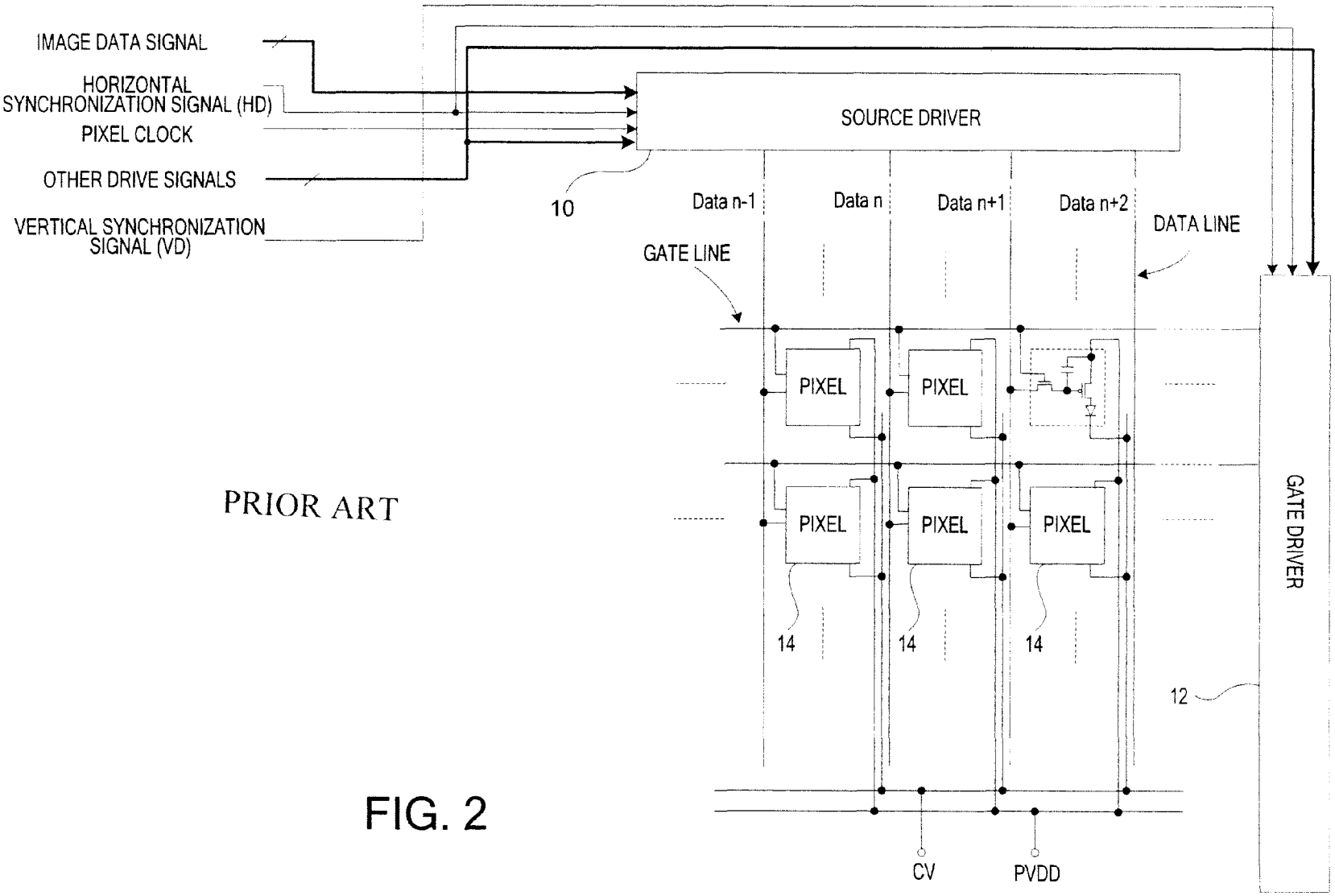
PRIOR ART FIG. 2
FIG. 2 shows an example configuration of a display module and input signals.
Figure 3:
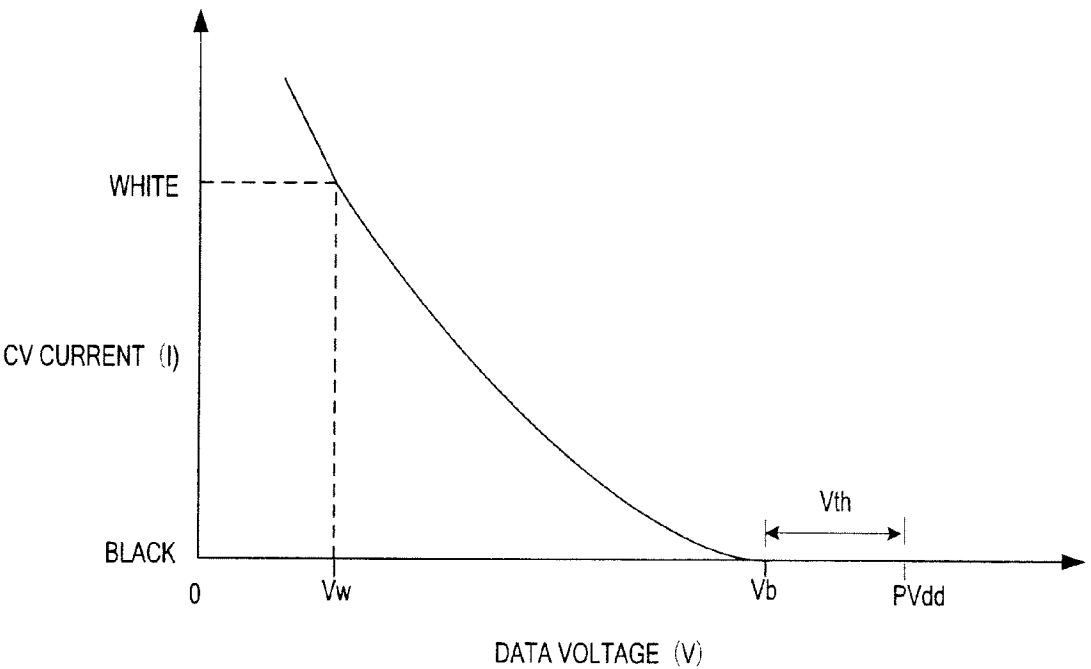
FIG. 3 shows a relationship between an input signal voltage (voltage of data line Data) of a drive TFT 1 and a CV current flowing in an organic EL element 3 (corresponding to the brightness)
Figure 4:
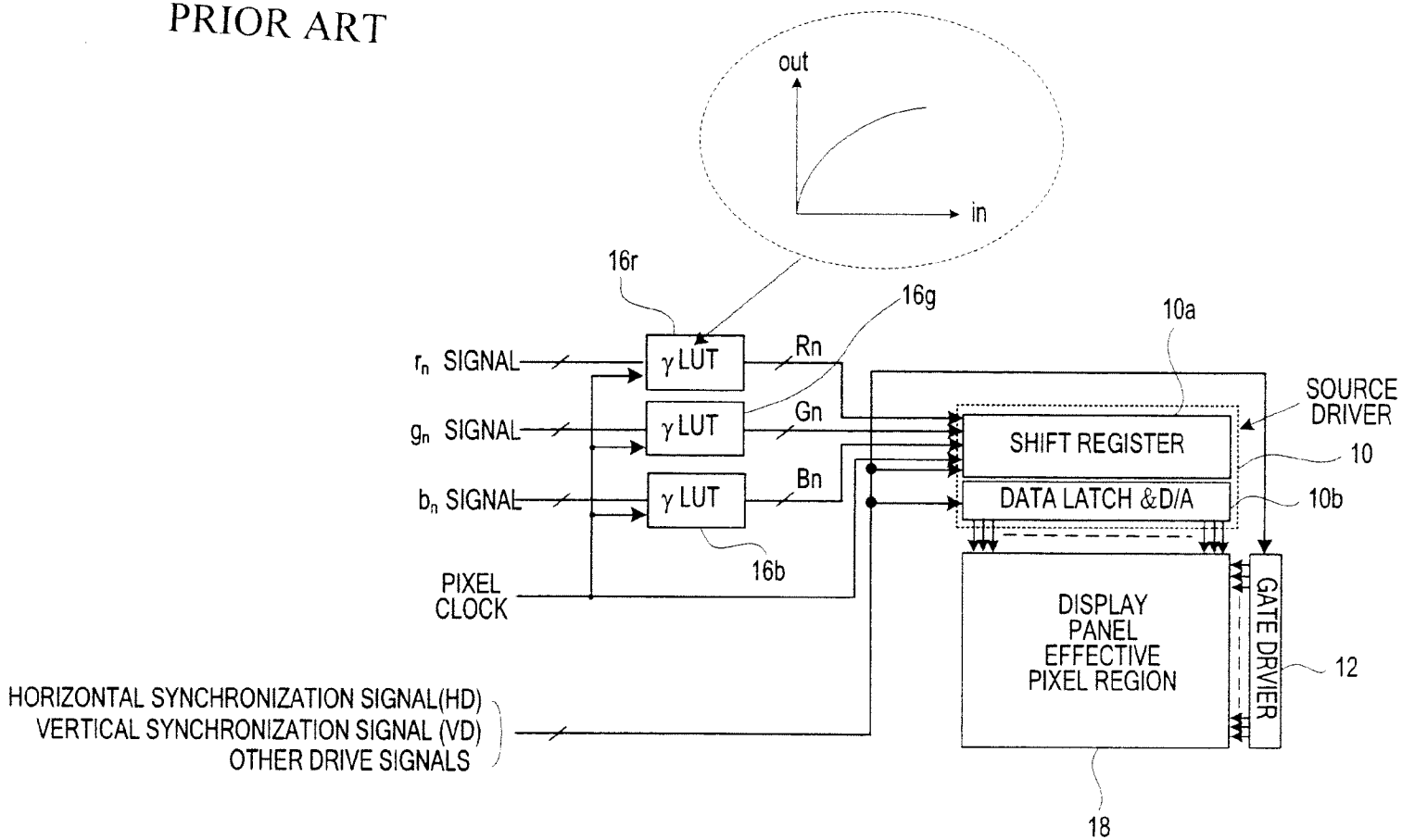
PRIOR ART FIG. 4
FIG. 4 shows a configuration for gamma correction of an image signal.
Figure 5:
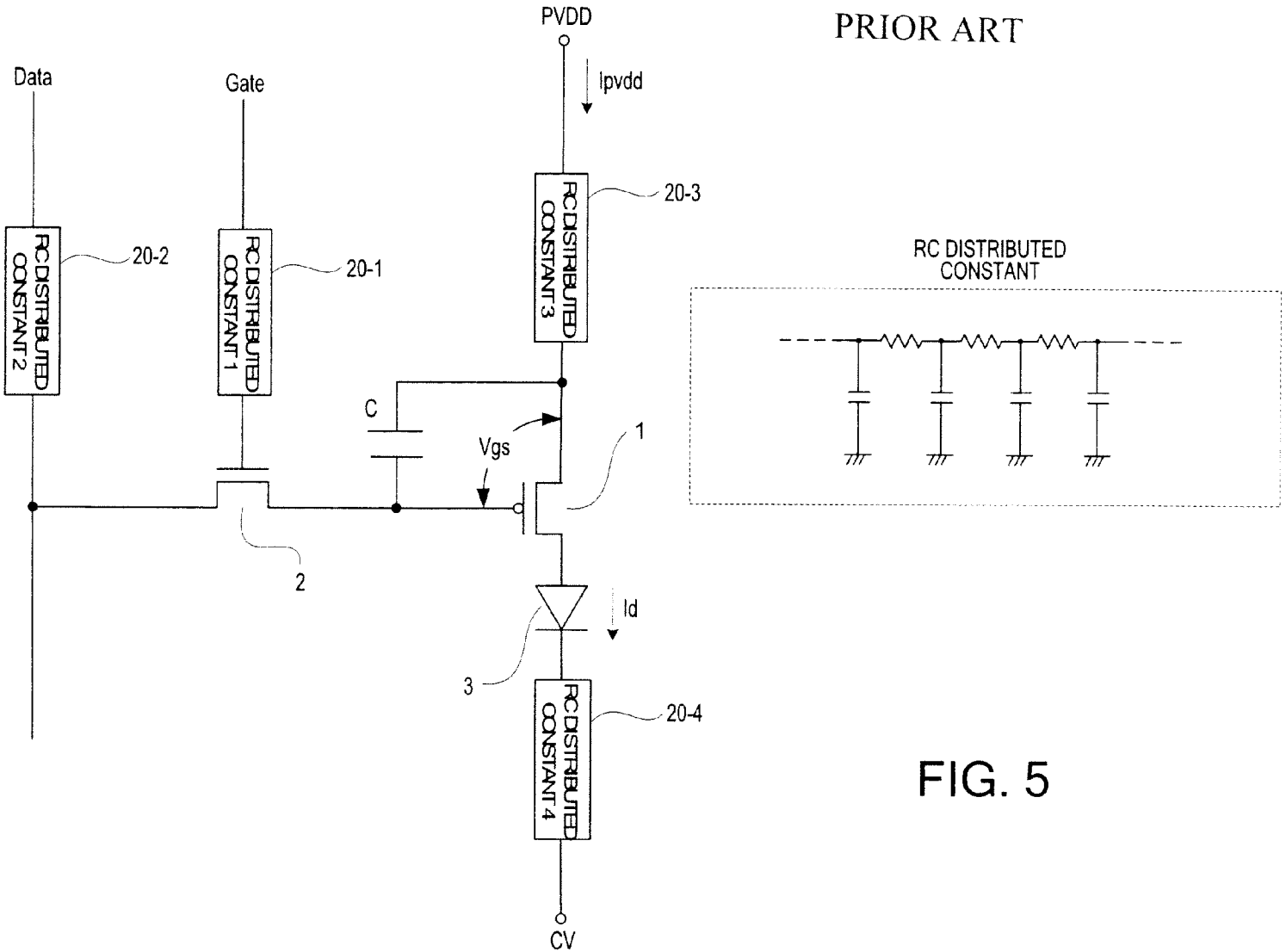
FIG. 5 shows distributed constant circuits (RC distributed constant circuits) based on, for example, wiring resistance and stray capacitance.
Figure 6:
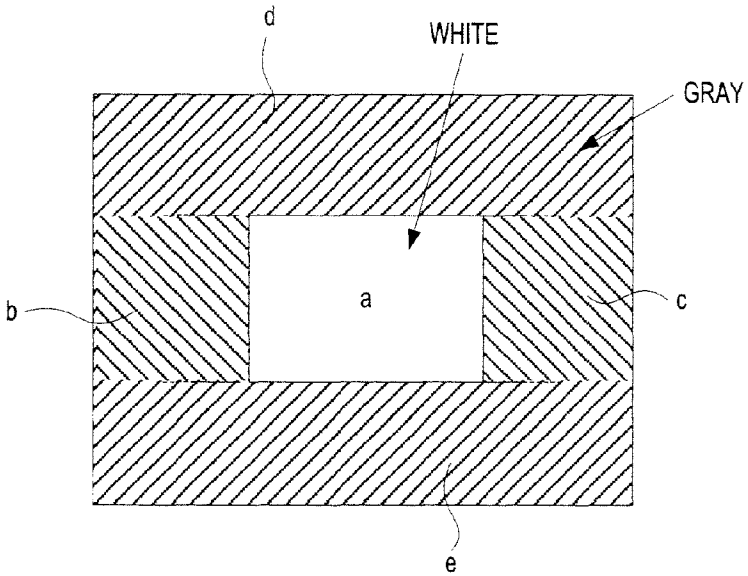
FIG. 6 shows display unevenness caused by crosstalk.
Figure 7:
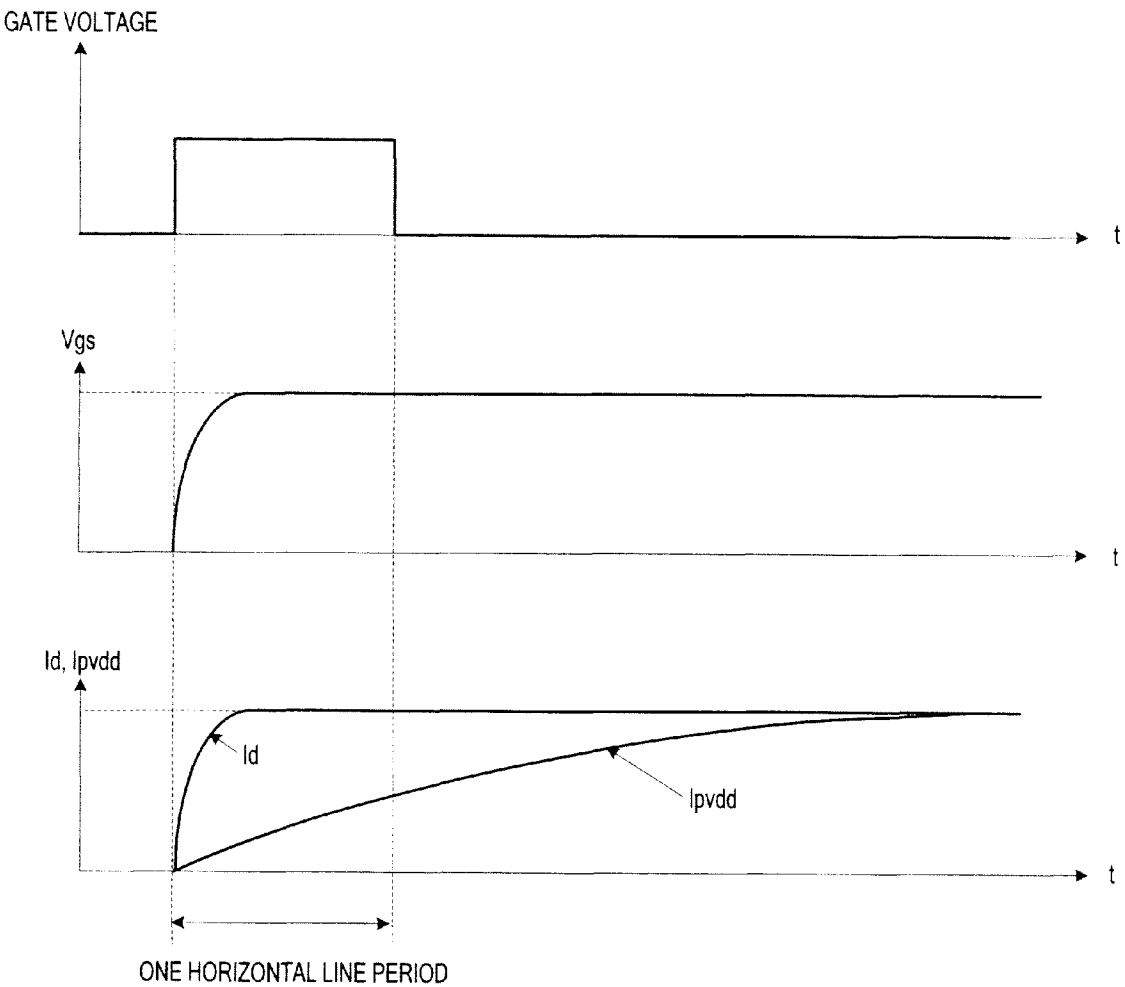
FIG. 7 shows an example of a relationship between a current Id flowing in an organic EL element and a PVdd current.

Because, during measurement of a pixel current, PVDD lines except for the PVDD line to which the horizontal line of the measured pixel is connected are unconnected, it is possible to remove pixel currents including leak currents occurring during light-off time and improve the measurement accuracy. In addition, parasitic capacitance of the PVDD line is lowered (capacitance component shown as the distributed constant 3 in FIG. 5) and the rise time of the Ipvdd becomes faster. In this regard, it is preferable to connect all the horizontal lines to respective independent power supply terminals. Further, in order to reduce the number of terminals, it is also preferable to connect between end portions of a plurality of horizontal lines and connect the connected end portions to an independent power supply terminal, provided that resistance components in the connecting line in the vertical direction, the measured current speed, and the measurement accuracy all fall within acceptable ranges.

When resistance in the power supply lines in the horizontal direction and voltage drops caused by currents flowing therein are not negligible, and, when the resistances and the voltage drops influence the evenness in brightness, the voltage drops occurring before reaching the pixels are obtained by calculation to correct display data so as to cancel the voltage drops.

Figure 8B:
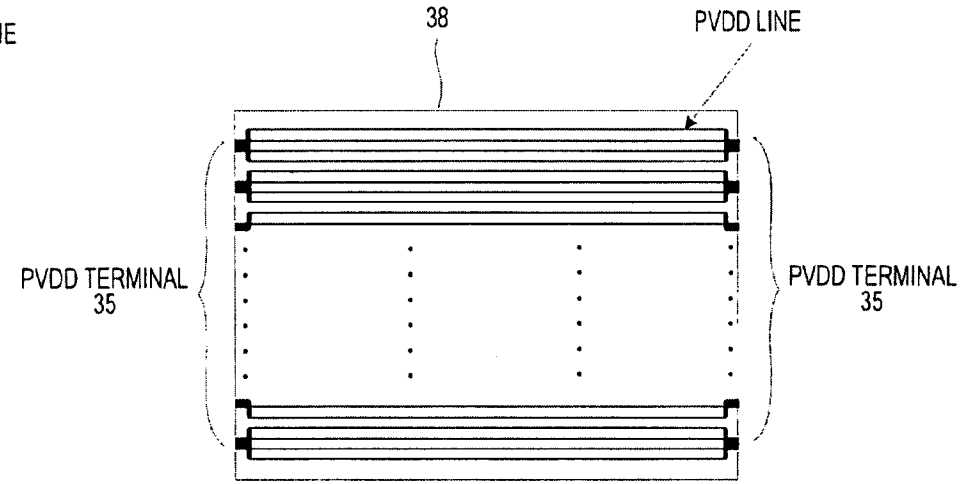
FIG. 8B shows an example of an arrangement of PVDD lines and PVDD terminals (on both sides)
Figure 8A:
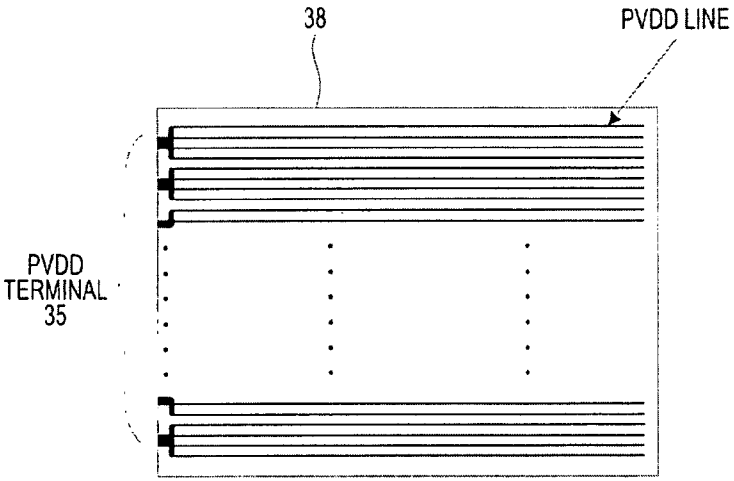
FIG. 8A shows an example of an arrangement of PVDD lines and PVDD terminals (only on the left side)

FIG. 8A and FIG. 8B show example arrangements of PVDD lines and PDVV terminals 35. FIG. 8A shows an example in which four horizontal PVDD lines are coupled by a PVDD terminal 35 on one side, and FIG. 8B shows an example in which four horizontal PVDD lines are coupled by the PVDD terminals 35 on both sides.

Figure 9:
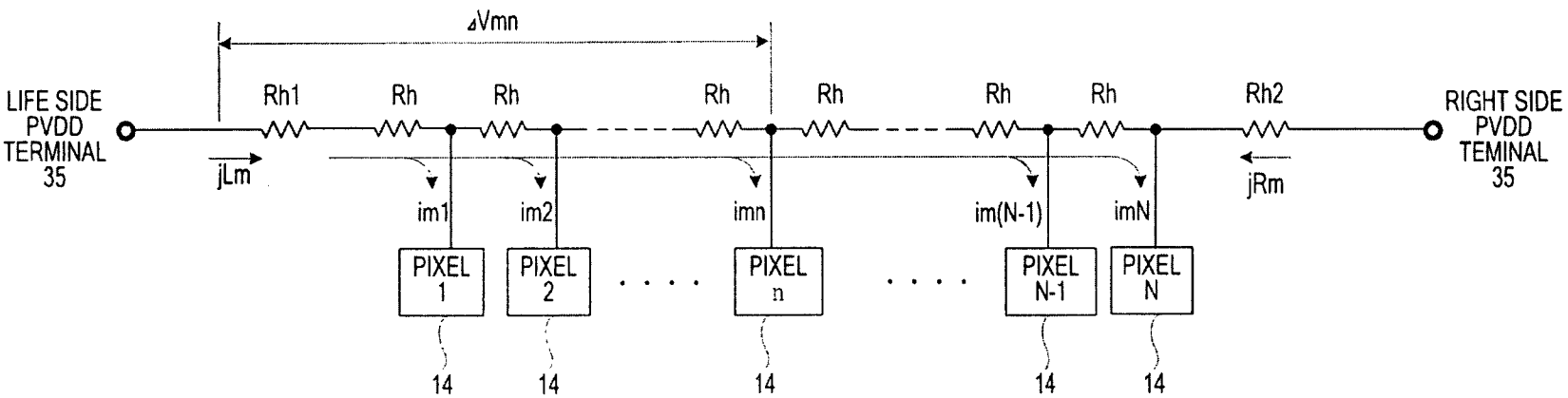
FIG. 9 shows an equivalent circuit with respect to a resistance component in a single line when PVDD terminals are provided on both sides.

FIG. 9 shows an equivalent circuit with respect to a resistance component of a single line in FIG. 8B in which the PVDD terminals 35 are provided on both sides, on the assumption that resistance in the power supply line in the vertical direction (vertical PVDD line) is negligible. It is assumed that the intervals between the pixels are the same and resistance values between the pixels are also the same. This resistance is expressed as $R_h$. It is also assumed that the distance from the left side PVDD terminal 35 to a pixel 1 and the distance from the right side PVDD terminal 35 to a pixel N are different from the distances between the pixels, and that resistances thereof are also different from $R_h$. The resistance values in the above two distances are expressed as $R_{h1}+R_h$ and $R_{h2}$, respectively. Here, a voltage drop ($\Delta V_{mn}$) from the left side PVDD terminal up to the pixel n in row m is expressed using $\Delta V_{m(n-1)}$ as shown in the following expressions.

$$\begin{aligned}
\Delta V_{m0} &= j_{Lm} R_{h1} \\
\Delta V_{m1} &= \Delta V_{m0} + j_{Lm} R_h \\
\Delta V_{m2} &= \Delta V_{m1} + (j_{Lm} - i_{m1}) R_h \\
\Delta V_{m3} &= \Delta V_{m2} + (j_{Lm} - i_{m1} - i_{m2}) R_h \\
&\ldots \\
&\ldots \\
&\ldots
\end{aligned} \tag{1}$$

-continued $$\Delta V_{mn} = \Delta V_{m(n-1)} + \left( j_{Lm} - \sum_{k=1}^{n-1} i_{mk} \right) R_h$$

Here, $j_{Lm}$ denotes a current flowing from the left side PVDD terminal 35 shown in FIG. 9. Assuming that voltages applied to the PVDD terminals 35 on both sides are the same, the current is expressed by the following expression:

$$j_{Lm} = \frac{i_{m1}\{(N-1)R_h + R_{h2}\}}{NR_h + R_{h1} + R_{h2}} + \frac{i_{m2}\{(N-2)R_h + R_{h2}\}}{NR_h + R_{h1} + R_{h2}} + \frac{i_{m3}\{(N-3)R_h + R_{h2}\}}{NR_h + R_{h1} + R_{h2}} + \ldots + \frac{i_{mN} R_{h2}}{NR_h + R_{h1} + R_{h2}} = \frac{1}{NR_h + R_{h1} + R_{h2}} \sum_{k=1}^{N} i_{mk}\{(N-k)R_h + R_{h2}\} \quad (2)$$

In addition, when only the left side PVDD terminal 35 is connected to the power supply as shown in FIG. 8A, the current $j_{Lm}$ flowing from the left side PVDD terminal 35 is expressed by the following expression:

$$j_{Lm} = \sum_{k=1}^{N} i_{mk} \quad (3)$$

Because currents im1 to imN that flow in the pixels of the horizontal line (line m) can be obtained from image data of the pixels, the voltage drop $\Delta V_{mn}$ that occurs before reaching the nth pixel in the horizontal direction can be obtained by calculation, provided that $Rh_1$, $Rh_2$, and $R_h$ are known beforehand.

As such, by adding $\Delta V_{mn}$ of the voltage drop to the image data for each of the pixels, it is possible to correct a decrease in the pixel currents in the horizontal PVDD line.

Image data ($D_{mn}$) before D/A conversion and an image drive voltage (voltage $V_{mn}$ of the data line) are in a proportional relationship. Therefore, if the proportionality constant is A, then $D_{mn}=AV_{mn}$, and $\Delta D_{mn}=A\Delta V_{mn}$ hold true. Further, in a display device having a function of performing gamma correction to achieve a linear relationship between input data and a pixel current, pixel current ($i_{mn}$) and image data before gamma correction ($d_{mn}$) are in a proportional relationship. Therefore, if K is the proportionality constant, then $i_{mn}=Kd_{mn}$. If $J_{Lm}=Aj_{Lm}$, Expression 1 and Expression 2 can also be expressed as follows using image data before and after γLUT.

That is, the following expression is obtained from Expression 1.

$$\Delta D_{mn} = \Delta D_{m(n-1)} + \left( J_{Lm} - AK \sum_{k=1}^{n-1} d_{mk} \right) R_h \quad (4)$$

$$\text{where } \Delta D_{M0} = J_{Lm} R_{h1}$$

The following expression is further obtained from Expression 2.

$$J_{Lm} = \frac{AK}{NR_h + R_{h1} + R_{h2}} \sum_{k=1}^{N} d_{mk}\{(N-k)R_h + R_{h2}\} \quad (5)$$

In addition, when the left side PVDD terminal alone is connected to the power supply, the following expression holds true:

First, the following expression is obtained from Expression 3.

$$J_{Lm} = AK \sum_{k=1}^{N} d_{mk} \quad (6)$$

Specific Examples

Figure 10B:
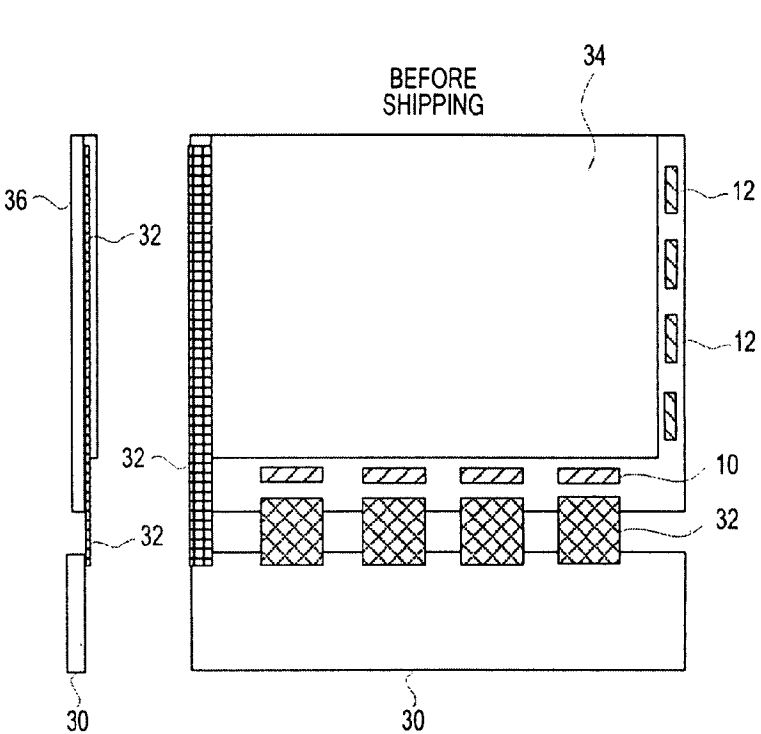
FIG. 10B shows an example of a module configuration before shipment in which PVDD terminals are provided only on the left side and these PVDD terminals are connected to a PVDD power supply.
Figure 10A:
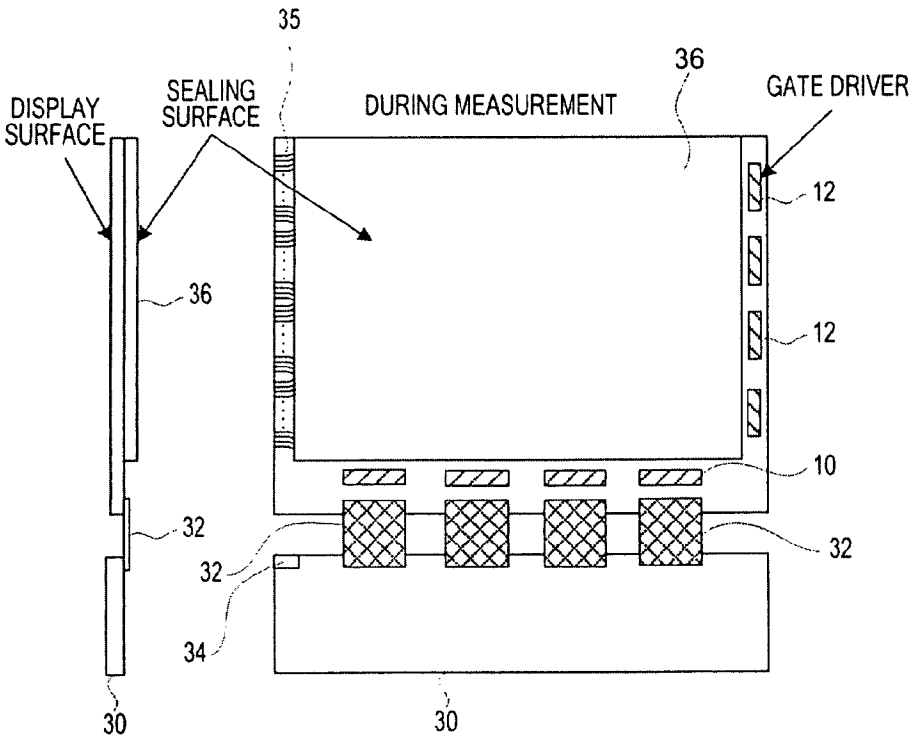
FIG. 10A shows an example of a module configuration during measurement in which PVDD terminals are provided only on the left side and these PVDD terminals are connected to a PVDD power supply.

FIG. 10A and FIG. 10B show example module configurations during measurement and at the time of shipment, respectively, in which PVDD terminals 35 are provided only on the left side and the PVDD power supply is connected to those PVDD terminals. In the example shown in FIG. 10B, at the time of shipment, the PVDD terminals 35 are connected to a power supply terminal 34 of a TCON and image-processing board (printed circuit board (PCB)) 30 using a coupling flexible cable (FPC) 32. An AFC (anisotropically-conductive film) is preferably used to connect the FPC 32 to an array substrate (panel) 38 that constitutes a display panel, and a connector or soldering is preferably used to connect the FPC 32 to the TCON and image process board 30 in order to reduce connection resistance. When vertical PVDD lines are provided on both sides of the panel, at the time of shipment, all the right side horizontal PVDD lines 35 are coupled using FPC or the like and are at the same time connected to the power supply terminals on the PCB similarly to the left PVDD terminals 35.

Figure 11:
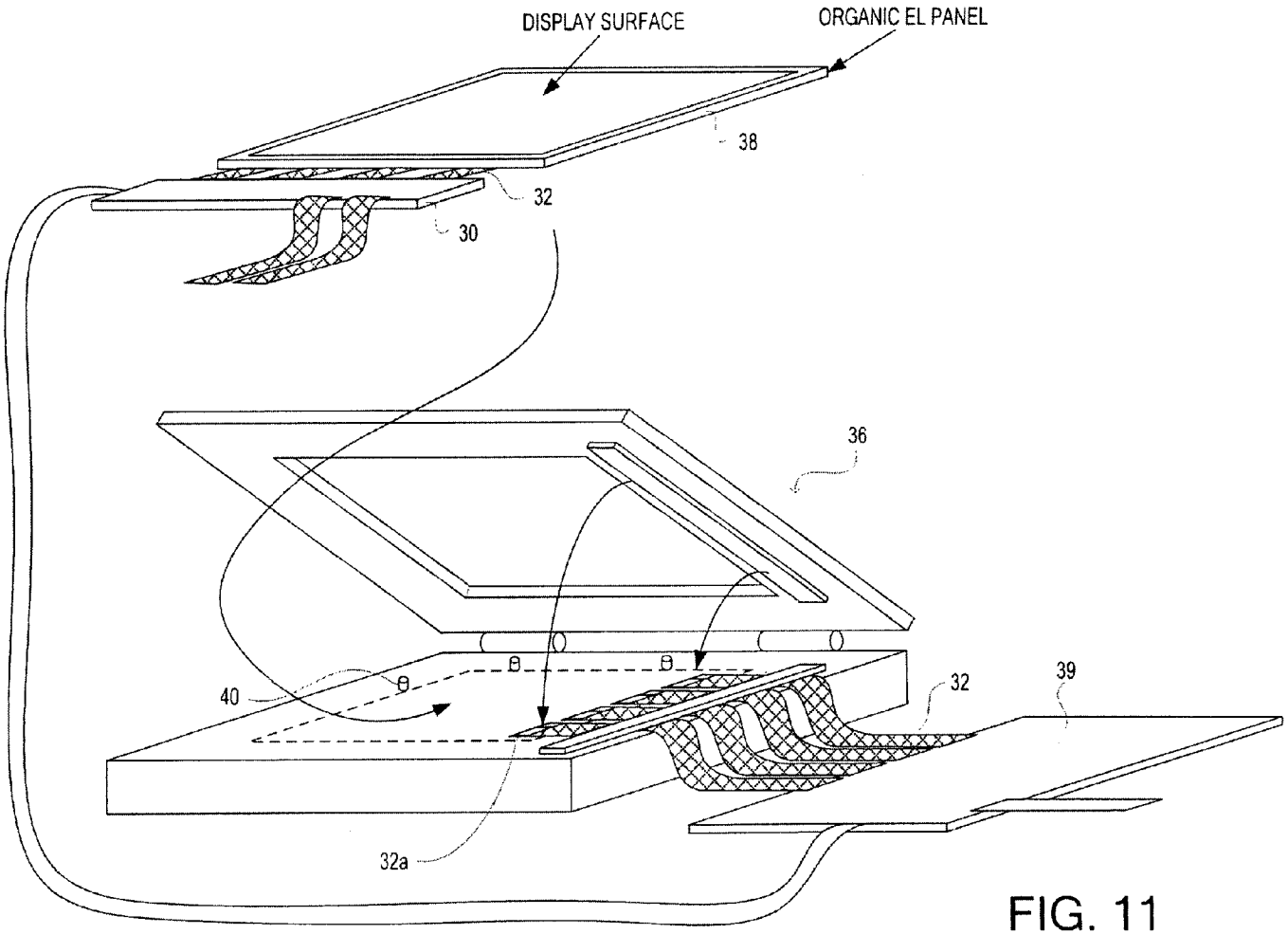
FIG. 11 shows a connection between a panel and a current measurement board.

During measurement of a current, as shown in FIG. 11, the FPC 32 extending from a current measurement board 39 is placed at a position on a panel clamp jig 36 at which the PVDD terminals 35 of the panel 38 are located. A contact portion 32*a* of the FPC 32 and the PVDD terminals 35 of the panel 38 are overlapped on each other, and pressure is applied thereon from above using the panel clamp jig 36, thereby placing the terminals of the FPC 32 and the PVDD terminals 35 of the panel 38 in contact with each other. The organic EL panel 38 is placed at a position indicated by the dashed line on the panel clamp jig 36, and positioning pins 40 are provided to help in positioning of the organic EL panel.

Figure 12:
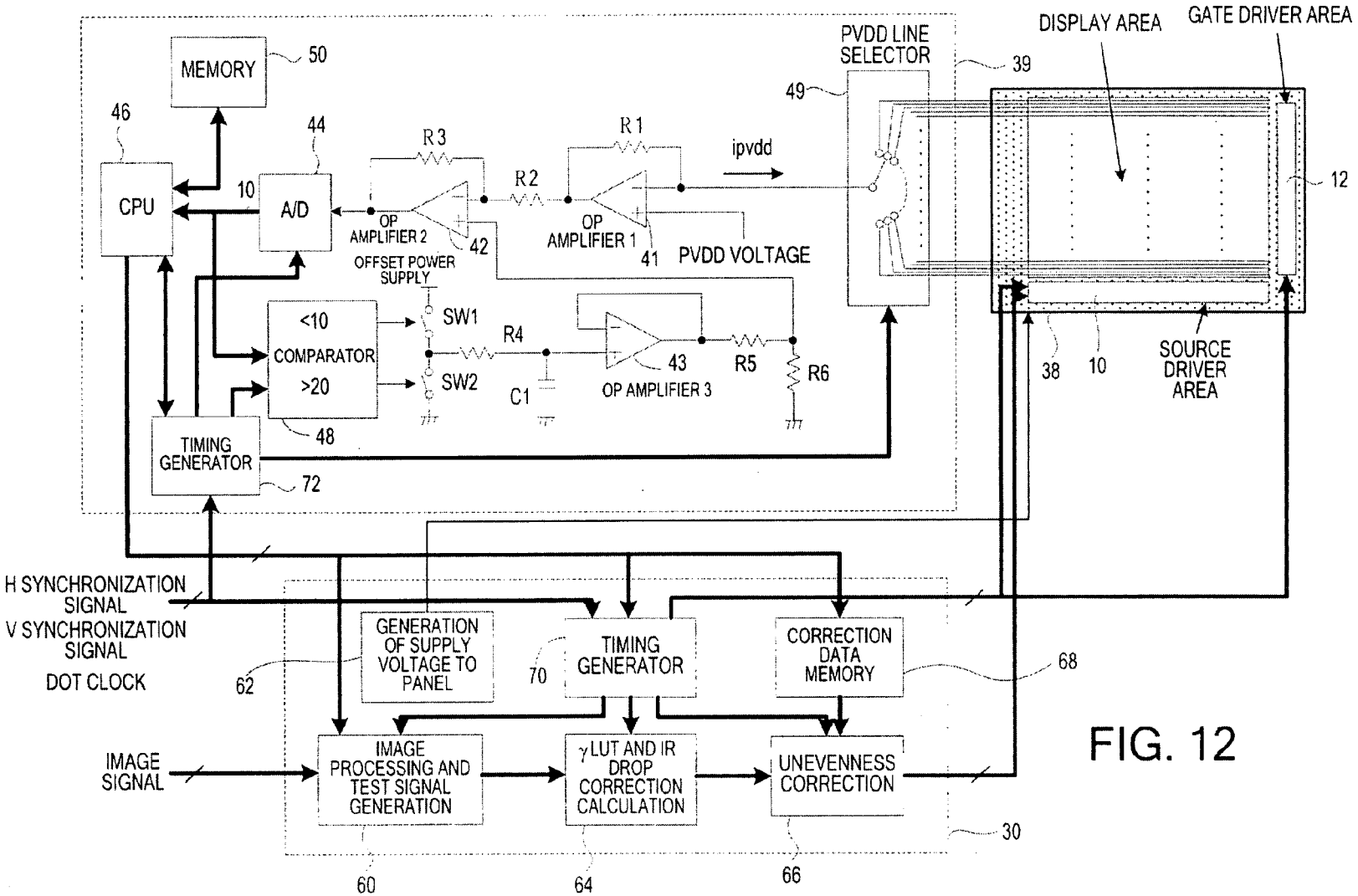
FIG. 12 is a block diagram showing a circuit configuration during current measurement.

FIG. 12 is a block diagram showing a circuit configuration during measurement of a current. An image processing and test signal generating block 60 of the TCON and image processing board 30 generates pixel data used in measuring a pixel current in accordance with a command from a CPU 46 of the current measurement board 39. In other words, image signals for sequentially turning on pixels one by one are generated and provided to the panel 38. The TCON and image processing board 30 is provided with a supply voltage generating block 62 for the panel, and the supply voltage generating block 62 generates various supply voltages necessary for driving the panel, including, for example, a PVDD voltage supplied to the above-described power supply terminal 34.

For normal screen display, the image processing and test signal generating block 60 outputs image signals to be supplied to the panel based on image signals supplied from outside. This pixel signals from the image processing and test signal generating block 60 are supplied to a γLUT and IR drop correction calculation block 64. The γLUT and IR drop correction calculation block 64 performs gamma correction and corrects a voltage drop in the power supply line. An output from the γLUT and IR drop correction calculation block 64 is supplied to an unevenness correction block 66. The unevenness correction block 66 corrects the image signals based on correction data for each pixel which are stored in a correction data memory 68. The correction data memory 68 stores correction data for each pixel which are calculated based on a pixel current measured by turning on each pixel.

Further, the TCON and image processing board 30 is provided with a timing generation circuit 70, and the timing generation circuit 70 outputs, for example, a pulse for driving each of the blocks and a pulse for driving a driver on the panel.

Here, during measurement of a pixel current, the timing generation circuit 70 is permitted to output a timing signal which differs from one for normal display operation, in order to measure all the pixels at high speed. This way, the measurement can be completed at high speed. In such a case, it is necessary to design the source driver and the gate driver of the panel 38 so as to operate in response to the timing signal used in measuring the pixel current.

A circuit configuration of a current measurement board 39 will be described hereinafter.

The PVDD terminals 35 of the panel 38 are selected individually via a PVDD line selector 49 and connected to a negative input of an OP amplifier 41. The PVDD voltage is supplied to a positive input terminal of the OP amplifier 41. A pixel current Ipvdd is supplied from the PVDD terminal 35, and a feedback resistor R1 is located between a negative input terminal and an output terminal. Therefore, a voltage of (PVDD voltage+Ipvdd×R1) is output at an output terminal of the OP amplifier 41.

The output from OP amplifier 41 is input to a negative input terminal of an OP amplifier 42 via a resistor R2. A feedback resistor R3 is located between an output terminal and the negative input terminal of the OP amplifier 42, and a predetermined feedback voltage value (described later) is supplied to a positive input terminal of the OP amplifier 42. The gain of the OP amplifier 42 is therefore determined by the resistors R2 and R3. Resistance values of the resistors R2 and R3 are set such that an input to an A/D converter 44 (in a subsequent process) has optimal amplitude.

Figure 14:
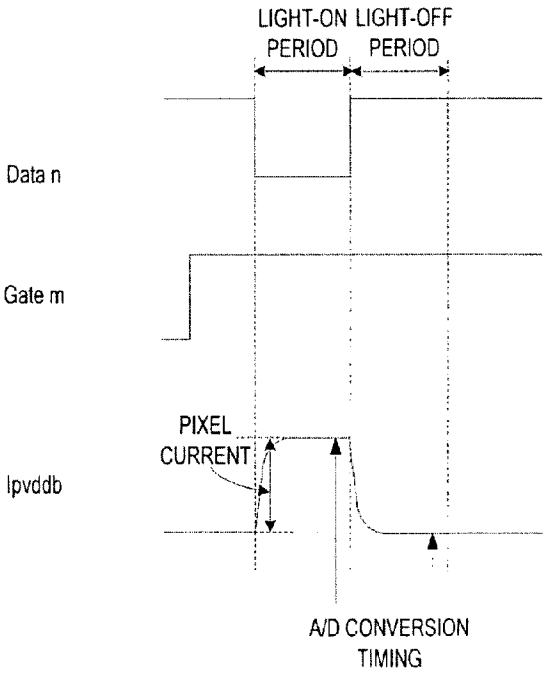
FIG. 14 shows a timing of measurement of a pixel current.

An output from the A/D converter 44 is supplied to the CPU 46. Here, the A/D converter 44 performs A/D conversion during a predetermined pixel current measurement period. The CPU 46 calculates a difference between current values obtained when a pixel current is made to flow (light-on period) and when the pixel current is stopped (light-off period), and sets the result as the pixel current of that pixel. Such a configuration enables removal of a noise component having a longer cycle than these sampling intervals. Further, in such a case, A/D conversion is preferably performed when the pixel current value is sufficiently stabilized as shown in FIG. 14. That is, A/D conversion is preferably performed in the latter part of each of the light-on period and the light-off period.

Further, because a current for one pixel is on the order of μA or less, the total gain up to the A/D converter 44 is very large, and the DC level of the output from the OP amplifier 42 is very unstable. Therefore, by feeding a bias voltage back to the OP amplifier 42 based on the A/D output value during the light-off time, a voltage during light-on time and a voltage during light-off time are controlled to fall within an input range of the A/D converter 44.

In this example, the output from the A/D converter 44 is composed of 10 bits, and the output is input to a comparator 48. The comparator 48 compares the output value from the A/D comparator 44 to 10 during light-on time and closes a switch SW1 if the output value is smaller than 10. With such a configuration, an offset power source is supplied to one end of a capacitor C1 via a resistor R4 and charged in the capacitor C1, while the other end of the capacitor 1 is grounded. The charging voltage of the capacitor C1 is supplied to a positive input terminal of an OP amplifier 43. The OP amplifier 43 has an output terminal short-circuited with its negative input terminal and thus stabilizes and outputs the charging voltage of the capacitor C1. An output of the OP amplifier 43 is grounded via voltage-dividing resistors R5 and R6, and a connecting point between the resistors R5 and R6 is supplied to the positive input terminal of the OP amplifier 42.

As such, when SW1 is turned on, and when the charging voltage is supplied to the capacitor C1 and voltage therein becomes higher, the bias voltage supplied to the positive input terminal of the OP amplifier 42 increases.

Further, when the output value during light-off time is larger than 20, the comparator 48 closes a switch SW2. With such a configuration, one end of the capacitor C1 is grounded via the resistor R4, and the charging voltage of the capacitor C1 decreases. The bias voltage of the OP amplifier 42 therefore decreases. In addition, when the output value during light-off time falls between 10 and 20, both SW1 and SW2 are open. Accordingly, the voltage of the capacitor C1 is maintained as is, and the bias voltage of the OP amplifier 42 is maintained. In order to avoid the influence of noises caused by ON and OFF operations of the switches, the ON and OFF operations are preferably performed in an intermittent manner by turning off all the pixels when, for example, measurement of one horizontal line or one vertical line is completed, and both SW1 and SW2 are preferably kept in the OFF state during times other than such period—that is, during measurement of a pixel current. Further, while the response speed is determined according to the duration in which SW1 or SW2 is kept ON and a time constant obtained from C1×R4, the response speed is advantageously set as slow as possible within the required range to decrease influence on the measurement accuracy. During measurement of a pixel current, various timings are controlled by a timing clock from a timing generating circuit 72 which is provided on the current measurement board 39.

As such, with the configuration shown in FIG. 12, feedback control is performed so that an output from the A/D converter 44 regarding a pixel current during light-off time falls within a predetermined range (in this example, 10 to 20). Therefore, even when the pixel current in light-off time changes, relatively accurate comparison can be performed between the pixel current during light-off time and a pixel current during the light-on time.

Figure 13:
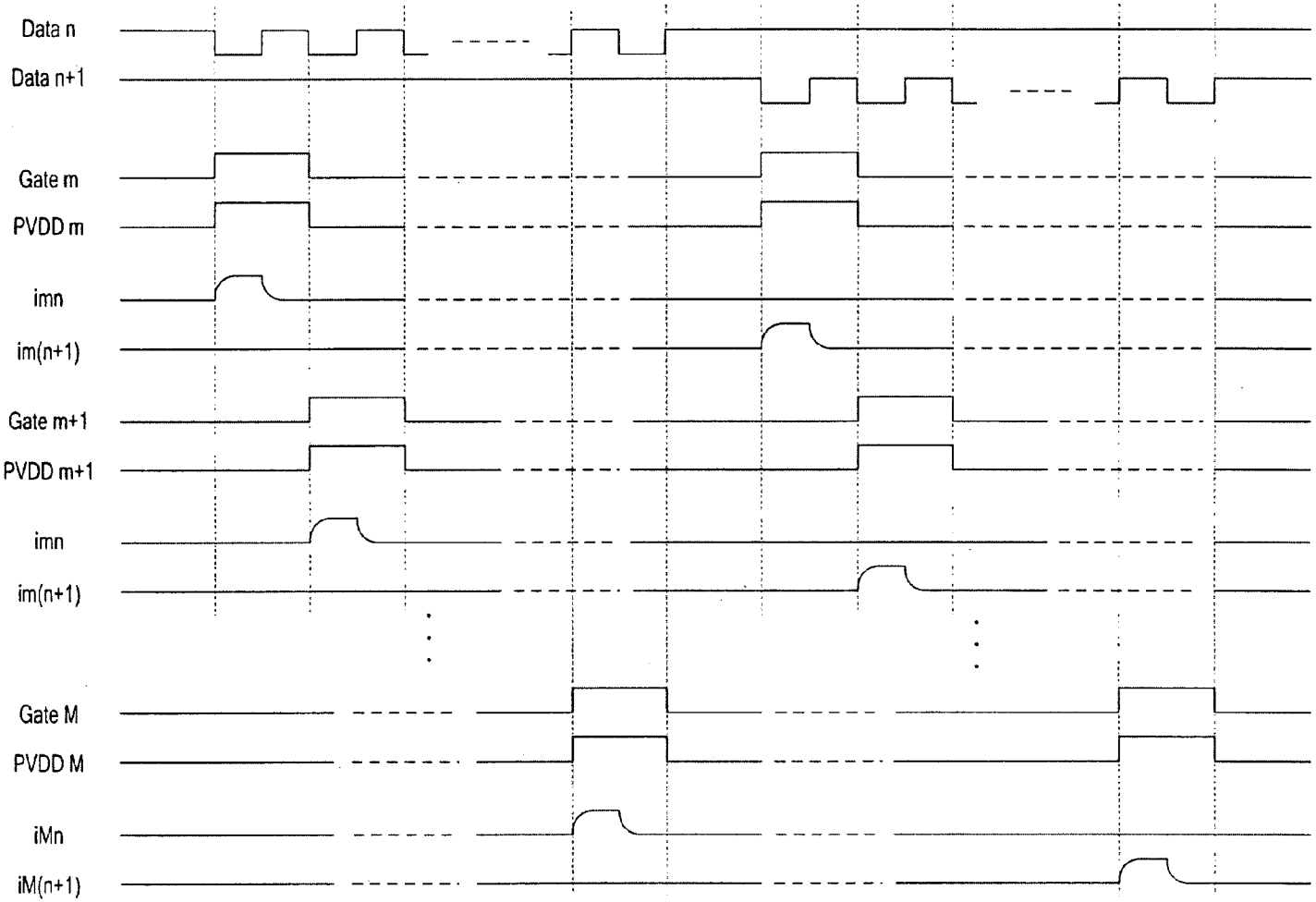
FIG. 13 shows an example of drive timings for measuring pixel currents sequentially.
Figure 15:
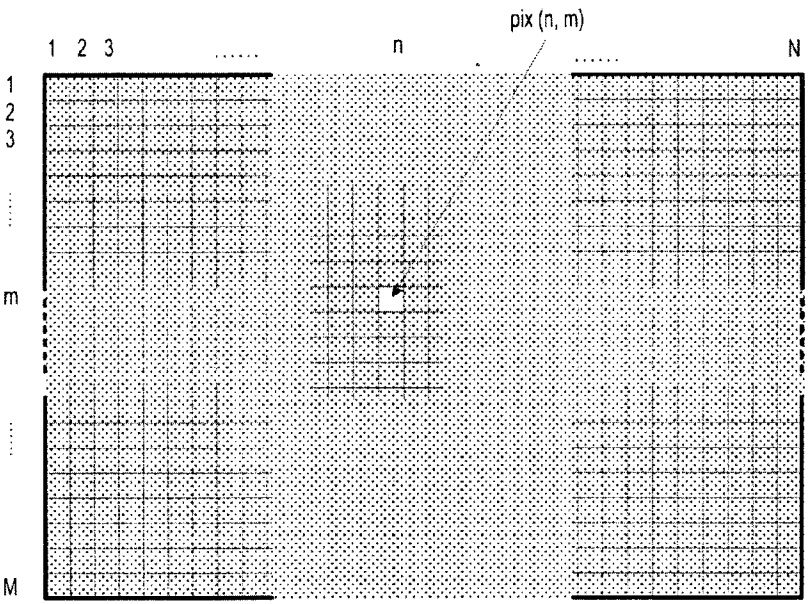
FIG. 15 shows a position of a pixel in a display area having M rows and N columns.
Figure 16B:
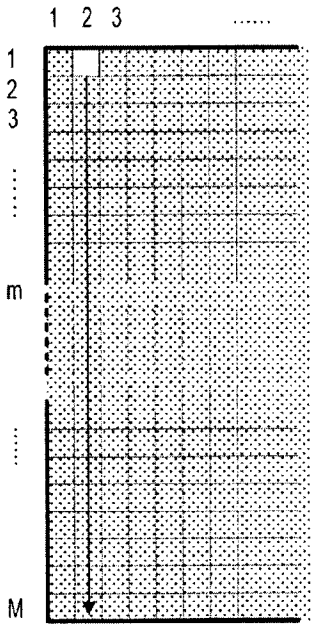
FIG. 16B shows another order of selecting pixels during measurement of a pixel current.
Figure 16A:
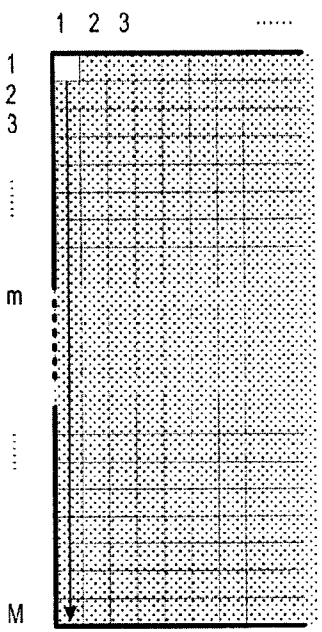
FIG. 16A shows the order of selecting pixels during measurement of a pixel current.

FIG. 13 shows an example of drive timings for measuring a pixel current at a high speed according to the order indicated in FIGS. 16A and 16B. FIG. 15 shows an arrangement of pixels in a display area having M rows and N columns, and a pixel in row m and column n is indicated as pix (n, m).

As shown in FIG. 13, the timing of supplying power to the horizontal PVDD in row m (PVDD m) and the timing of selecting the gate of the horizontal line of row m (Gate m) (setting to H level) are the same, and a data voltage for measurement use (Data n) is output to only a column including a pixel to be measured (column n). In order to prevent the current from flowing into pixels other than the pixel to be measured, the source driver outputs, as other outputs, voltages having a value equal to or greater than black level.

Further, as shown in FIGS. 16A and 16B, measurement is performed such that data in line n alone are changed until measurement of a single line from pix (n, 1) to pix (n, M) in the vertical direction is completed, and subsequently such that the next line from pix (n+1, 1) to pix (n+1, M) in the vertical direction is measured while changing data in line n+1 alone. Moreover, ON and OFF operations of the above-described SW1 and SW2 for offset voltage supply use are preferably performed between the measurement of pix (n, M) and the measurement of pix (n+1, 1).

Figure 17:
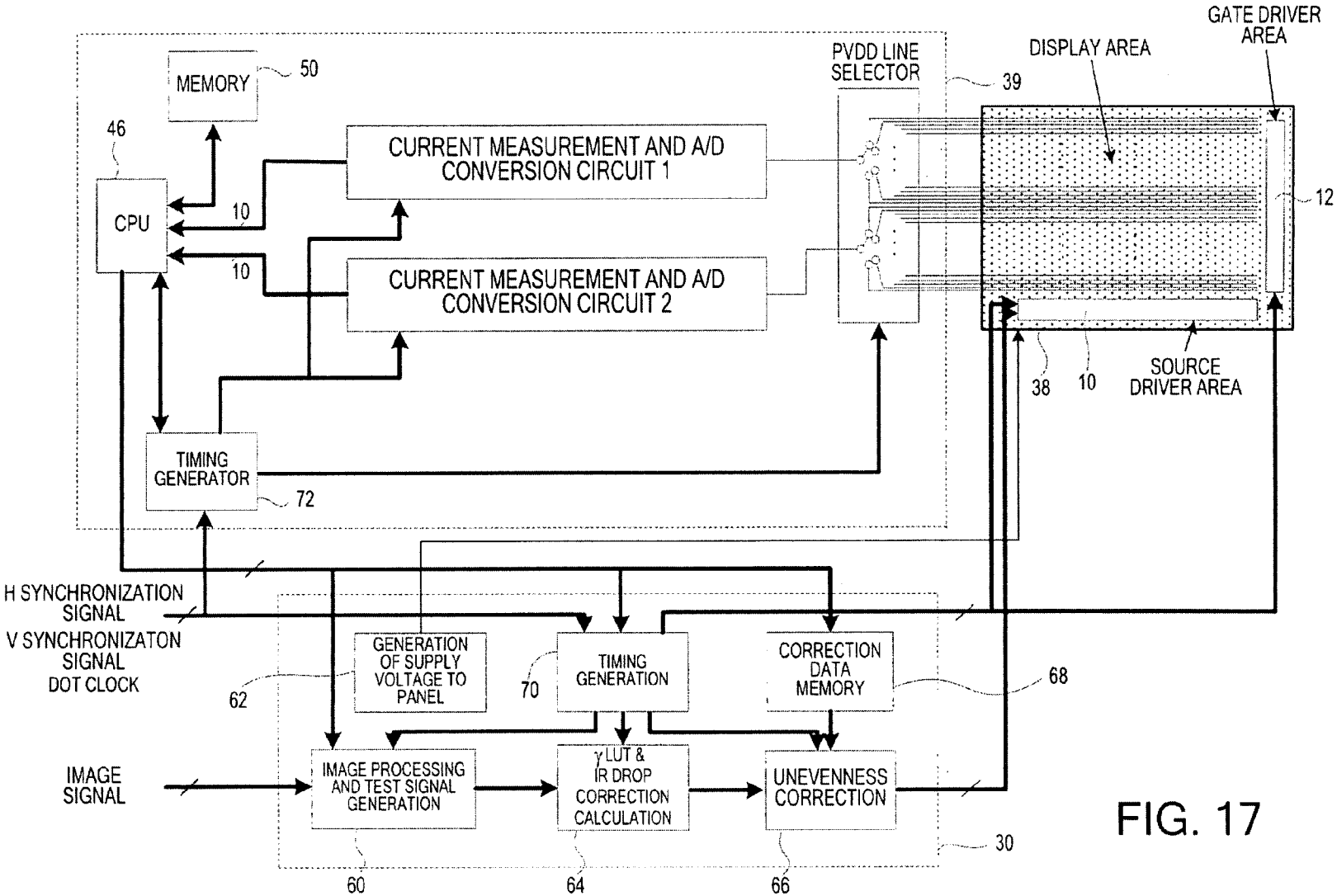
FIG. 17 shows a circuit configuration for measuring currents in two pixels simultaneously.

Although in this example PVDD voltage is sequentially supplied to each of the horizontal lines and measurement is performed pixel by pixel, it is also possible to provide a plurality of circuits for current measurement and measure currents while applying voltages to a plurality of PVDD lines simultaneously. In such an example, it is possible to simultaneously select gates of the horizontal PVDD lines to which voltages are supplied and measure currents of a plurality of pixels within the same column. It is thus possible to reduce the measurement time. FIG. 17 shows a circuit configuration in which voltages are respectively supplied to horizontal PVDD lines in the upper portion and the lower portion of the panel, and currents in two pixels are simultaneously measured.

Further, although in the present example the pixel currents are measured while pixels to be measured are shifted from one to another in the vertical direction, the pixel currents can be measured in the horizontal direction. In such a case, until measurement of a single horizontal line is completed, power supply of a horizontal PVDD and a gate line of the line are kept ON, and the pixel to be measured is shifted from one to another while being turned on and off. In such a case, it is also preferable to obtain a current of a pixel by employing a difference between current values during light-on time and during light-off time as shown in FIG. 14.

The invention has been described in detail with particular reference to certain preferred embodiments thereof, but it will be understood that variations and modifications can be effected within the spirit and scope of the invention.

PARTS LIST

1 drive TFT
2 selection TFT
3 organic EL element
10 source driver
10*a* shift register
10*b* D/A
12 gate driver
14 pixels
16 gamma correction circuit
16*r* gamma correction circuit
16*g* gamma correction circuit
16*b* gamma correction circuit
18 pixel region
20 distributed constant circuits
30 image-processing board
32 coupling flexible cable
32*a* contact portion
34 power supply terminal
35 PVDD terminals
36 panel clamp jig
38 panel
39 current measurement board
40 positioning pins
41 OP amplifier
42 OP amplifier
43 OP amplifier
44 A/D converter
46 CPU
48 comparator
49 PVDD line selector
60 generating block
62 generating block
64 calculation block
66 correction block
68 data memory
70 timing generation circuit
72 timing generating circuit

The invention claimed is:

1. A method of compensating for unevenness and voltage drop in an EL display, comprising:

(a) providing the EL display having a substrate;

(b) forming on the substrate a plurality of pixels arranged in a matrix of horizontal lines and vertical lines, each pixel having an organic EL element for display use and a TFT for controlling current supply to the organic EL element;

(c) forming on the substrate a plurality of power supply lines corresponding to the horizontal lines of the matrix, each supplying power to pixels of the corresponding horizontal line;

(d) forming on the substrate a plurality of independent wiring terminals, each connected to one or more of the plurality of power supply lines;

(e) prior to displaying an image, selecting a pixel;

(f) providing a first image signal to the EL display to turn on the selected pixel;

(g) measuring a first pixel current;

(h) providing a second image signal to the EL display to turn off the selected pixel;

(i) measuring a second pixel current;

(j) calculating a difference between the first pixel current and the second pixel current, calculating correction data based on the difference, and storing the correction data;

(k) repeating steps (e) through (j) for an unselected pixel until all of the pixels have been selected;

(l) receiving for each of the plurality of pixels a respective third image signal corresponding to an image to be displayed;

(m) for each horizontal line, calculating a respective voltage drop of each pixel in the horizontal line, based on the respective third image signals for the pixels in the horizontal line, and adding the respective voltage drops to the respective third image signals to produce a plurality of respective first compensation signals;

(n) correcting the first compensation signals for unevenness using the stored correction data to produce second compensation signals; and (o) providing the second compensation signals to the EL display to display the image to be displayed while compensating for unevenness and voltage drop in the EL display.

2. The method according to claim 1, wherein step (d) includes connecting each of the plurality of independent wiring terminals to exactly one of the plurality of power supply lines.

3. The method of claim 1, wherein step (k) further includes coupling the plurality of independent wiring terminals together using a wiring material, after all pixels on the display have been selected and respective correction data have been stored.

* * * * *